US005121757A

United States Patent [19]

White et al.

[11] Patent Number: 5,121,757

[45] Date of Patent: Jun. 16, 1992

[54] TOBACCO TREATMENT PROCESS

[75] Inventors: Jackie L. White, Pfafftown; Thomas A. Perfetti, Winston-Salem, both of N.C.

[73] Assignee: R. J. Reynolds Tobacco Company, Winston-Salem, N.C.

[21] Appl. No.: 536,250

[22] Filed: Jun. 11, 1990

Related U.S. Application Data

[63] Continuation-in-part of Ser. No. 452,175, Dec. 18, 1989, Pat. No. 5,060,669.

[51] Int. Cl.[5] ..... A24B 15/24

[52] U.S. Cl. ..... 131/297; 131/298

[58] Field of Search ..... 131/297, 298, 309, 310; 426/478, 425, 428, 442

[56] References Cited

U.S. PATENT DOCUMENTS 4,079,742 3/1978 Ranier et al. .
4,150,677 4/1979 Osborne et al. .
4,244,381 1/1981 Lendvay .
4,256,123 3/1981 Lendvay et al. .
4,306,577 12/1981 Wu et al. .
4,497,330 2/1985 Banyasz et al. .
4,607,646 8/1986 Lilly, Jr. et al. .
4,638,816 1/1987 Cox et al. .
4,744,375 5/1988 Denier et al. .
4,756,318 7/1988 Clearman et al. .
4,825,884 5/1989 Denier et al. .
4,986,286 1/1991 Roberts et al. ..... 131/297

FOREIGN PATENT DOCUMENTS

72/3935 6/1972 South Africa .

*Primary Examiner*—V. Millin

[57] ABSTRACT

Flavorful tobacco extracts are provided by subjecting a tobacco extract to heat treatment. The tobacco extract is contacted with an ammonia compound capable of releasing ammonia or a base capable of releasing ammonia indigenous to the tobacco extract, and then is subjected to a heat treatment above about 100° C. in a pressure controlled environment. Resulting flavorful extracts are useful as forms of tobacco in cigarettes and other smoking articles.

30 Claims, 2 Drawing Sheets

TOBACCO TREATMENT PROCESS

This application is a continuation-in-part of U.S. Ser. No. 452,175 filed Dec. 18, 1989 now U.S. Pat. No. 5,060,669.

BACKGROUND OF THE INVENTION

The present invention relates to flavorful forms of tobacco for cigarettes and other types of smoking articles, and in particular, to processes for providing such flavorful forms of tobacco.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. No. 4,708,151 to Shelar; U.S. Pat. No. 4,771,795 to White et al; U.S. Pat. No. 4,714,082 to Banerjee et al; U.S. Pat. No. 4,756,318 to Clearman et al; and U.S. Pa. No. 4,793,365 to Sensabaugh, Jr. et al; and European Patent Publication Nos. 12,234 and 277,519 propose cigarettes and pipes which comprise a fuel element, an aerosol generating means physically separate from the fuel element, and a separate mouth end piece. Such types of smoking articles provide natural tobacco flavors to the smoker thereof by heating, rather than burning, tobacco in various forms.

As natural tobacco flavors are important components of smoking articles in order that such smoking articles can provide adequate tobacco taste and aroma, improved processes for providing natural tobacco flavor substances and flavorful forms of tobacco are desirable. It would be highly desirable to provide a process for efficiently and effectively producing these flavorful forms of tobacco.

SUMMARY OF THE INVENTION

The present invention relates to a process for providing flavorful natural tobacco substances which are useful forms of tobacco for various types of cigarettes and other smoking articles. In particular, a tobacco extract is contacted with a ammonia compound capable of releasing ammonia (e.g., anhydrous ammonia gas, ammonium hydroxide, etc.) by itself or from tobacco material and is subjected to heat treatment (i.e., a moderately high temperature treatment) under conditions sufficient to alter the chemical nature (e.g., the flavor and aroma characteristics) of the extract. Normally, the tobacco extract is exposed to a temperature sufficiently high and for a period of time sufficiently long so as to provide an extract which does not exhibit a "green" or harsh flavor. However, it is preferable that the tobacco extract not be exposed to such a high temperature for a sufficiently long period of time so as to provide an extract which exhibits a burnt, tarry, overly bitter or highly metallic flavor.

As an alternative to the use of an ammonia compound, the tobacco extract optionally can be contacted with a base capable of releasing ammonia by itself or from tobacco material on exposure to heat and pressure. Exemplary bases can include hydroxides, carbonates and bicarbonates of alkali and alkali earth metals (e.g., potassium, sodium, calcium, magnesium, etc.).

In addition to being contacted with an ammonia compound or base capable of releasing ammonia, the tobacco extract can be contacted with an amino acid, amino acid analog or amino acid source and/or a sugar or sugar source.

The contacted tobacco extract can be combined with an aqueous liquid and can be carried by a substrate during the time that the extract undergoes the moderately high temperature treatment. In addition, moist tobacco extract can be combined with an organic liquid (e.g., glycerin) prior to the time that the tobacco extract is subjected to the moderately high temperature treatment. Thus, for purposes of the present invention, it is convenient to refer to the heat treatment, or the moderately high temperature treatment, of a tobacco composition. For purposes of this invention, a tobacco composition can include (i) a tobacco extract contacted with an ammonia-containing compound or a base capable of releasing ammonia and an aqueous liquid, (ii) a tobacco extract contacted with an ammonia-containing compound or a base capable of releasing ammonia, an aqueous liquid, and a substrate which carries the extract and aqueous liquid, (iii) a tobacco extract contacted with an ammonia-containing compound or a base capable of releasing ammonia, an aqueous liquid and an organic liquid, or (iv) a tobacco extract, an ammonia-containing compound or a base capable of releasing ammonia, an aqueous liquid, an organic liquid and a substrate for the extract and liquids.

More particularly, the present invention relates to a process for treating natural tobacco substances by subjecting a tobacco extract contacted with an ammonia-containing compound or a base capable of releasing ammonia to exposure to a temperature above about 100° C. The tobacco extract has a moisture content of at least about 5 weight percent, preferably at least about 25 weight percent, when that extract is exposed to the moderately high temperature treatment; and the tobacco extract is subjected to such treatment while enclosed in a pressure controlled environment. In general, the pressure experienced by the extract is greater than ambient (i.e., atmospheric) pressure. For purposes of this invention, the term "moisture content" relates to the weight of the water within the tobacco composition relative to the total weight of the tobacco composition. The tobacco extract normally is subjected to such treatment in order that the entire extract is exposed to a temperature above about 100° C. for at least about 10 minutes.

The flavorful tobacco substances so provided are useful as forms of tobacco for smoking products. For example, such flavorful tobacco substances are useful as casing or top dressing components for tobacco laminae and cut filler, as well as for other smokable materials. Alternatively, such flavorful tobacco substances are useful as one form of tobacco employed in those types of smoking articles described in U.S. Pat. No. 4,708,151 to Shelar; U.S. Pat. No. 4,771,795 to White et al; U.S. Pat. No. 4,714,082 to Banerjee et al; U.S. Pat. No.

4,756,318 to Clearman et al; and U.S. Pat. No. 4,793,365 to Sensabaugh et al; as well as European Patent Publication Nos. 212,234 and 277,519. The flavorful tobacco substances also are useful spray dried, combined with adhesive agents, followed by casting on a metal surface and then cut to be used as filler material. The flavorful tobacco substances also are useful as cigarette filter additives. For example, the flavorful tobacco substances can be incorporated into low density polyethylene and formed into strands, and then incorporated into cigarette filters as described in U.S. Pat. No. 4,281,671 to Bynre et al and U.S. Pat. No. 4,862,905 to Green, Jr. et al. The flavorful tobacco substances also are useful as cigarette wrapper additives; or as additives to the inner regions of cigarette packages (e.g., within a paper/foil laminate of a cigarette package or within a low density polyethylene film which is placed within a cigarette package) in order to provide a desirable cigarette aroma and "pack aroma."

DETAILED DESCRIPTION OF THE PREFERRED EMBODIMENTS

Figure 1:
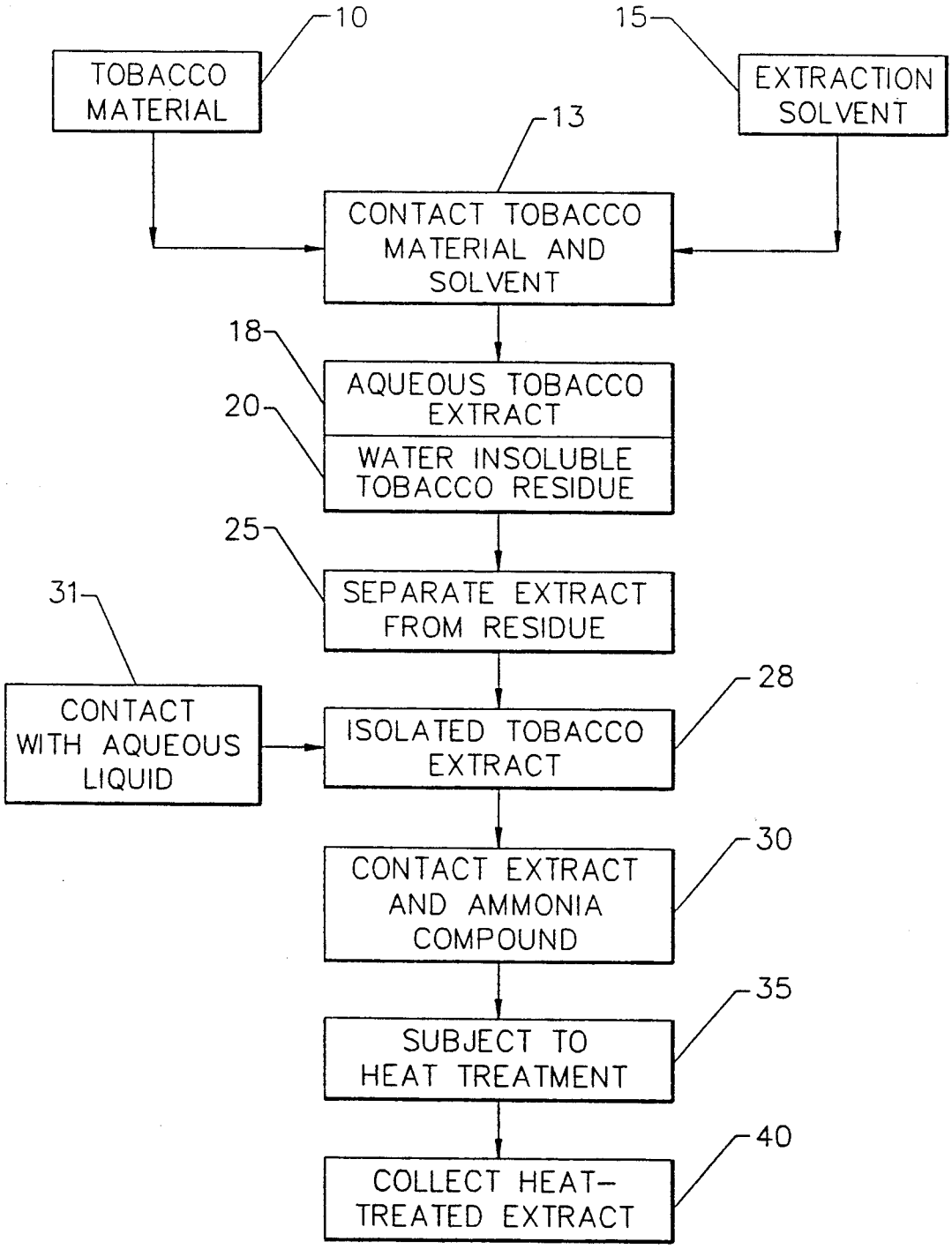
FIG. 1 is a schematic diagram of process steps representative of an embodiment of the present invention.

Referring to FIG. 1, tobacco material 10 is contacted 13 with an extraction solvent 15 having an aqueous character. As such, various soluble components are extracted from the tobacco material 10 yielding an aqueous tobacco extract 18 and a water insoluble tobacco residue 20. The aqueous tobacco extract 18 is separated 25 from the insoluble residue 20 using centrifugation techniques, or the like. The extracted tobacco components are separated from the solvent by distillation techniques followed by spray drying techniques, or the like. The resulting isolated tobacco extract 28 is in a relatively low solvent form. The extract then is contacted 30 with an ammonia compound capable of releasing ammonia by itself or from tobacco material. Optionally, the extract can be contacted 31 with a liquid having an aqueous character, such that a moist tobacco extract is provided. The contacted tobacco extract is subjected to a moderately high temperature treatment 35 in an enclosed, pressure controlled environment for a period of time sufficient to provide desirable flavor characteristics to the extract. The resulting heat-treated extract then is collected 40 for later use in the manufacture of cigarettes and other smoking articles.

Figure 2:
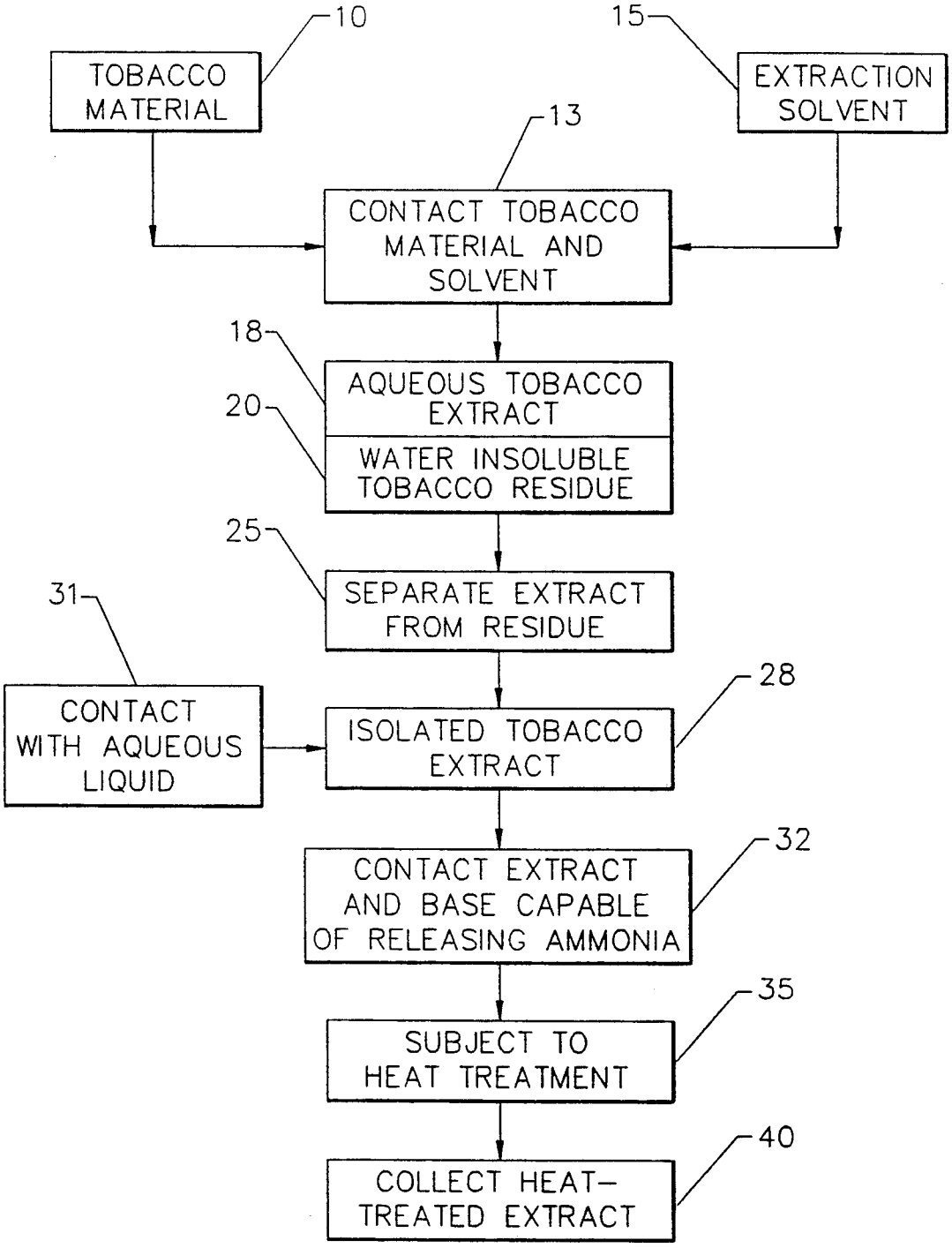
FIG. 2 is a schematic diagram of process steps representative of another embodiment of the present invention.

Referring to FIG. 2, another embodiment is illustrated with like numerals indicating aspects common to those in FIG. 1. Tobacco material 10 is contacted 13 with an extraction solvent 15 having an aqueous character yielding an aqueous tobacco extract 18 and a water insoluble tobacco residue 20. The aqueous tobacco extract 18 is separated 25 from the insoluble residue 20 using centrifugation techniques, or the like. The extracted tobacco components are separated from the solvent by distillation techniques followed by spray drying techniques or the like. The isolated extract 28 in low solvent form then is contacted 32 with a base capable of releasing ammonia from itself or from tobacco material. Additionally the extract can be contacted 31 with a liquid having an aqueous character such that a moist tobacco extract is provided. The tobacco extract is subjected to a moderately high temperature treatment 35 in an enclosed, pressure controlled environment for a period of time sufficient to provide desirable flavor characteristics to the extract. The resulting heat-treated extract then is collected 40.

The tobacco materials useful herein can vary. Tobacco materials which are used are of a form such that, under extraction conditions, a portion thereof is soluble in (i.e., extracted by) an extraction solvent; and a portion thereof is insoluble in (i.e., not extracted by) that extraction solvent. A typical insoluble tobacco material includes components of the biopolymer matrix of the tobacco (e.g., the cellulosics). Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form such as obtained by fermentation, pyrolysis, heat treatment, extraction and the like. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof. Optionally, the tobacco material can be ammoniated such as with anhydrous ammonia gas or aqueous ammonium hydroxide, or treated with an ammonia salt such as with mono-, di- or triammonium phosphates or ammonium carbonate. In this manner, the tobacco extract produced from ammoniated tobacco material (and thus have ammonia compounds present in the tobacco extract) can self-react when subjected to heat treatment conditions.

A tobacco extract can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be extracted using organic solvents (e.g., hexane, methanol or ethanol), halocarbons and halogenated hydrocarbons, supercritical fluids (e.g., supercritical carbon dioxide and supercritical sulfur hexafluoride), and the like. Preferably, the tobacco extract is provided by extracting the tobacco material using a liquid having an aqueous character. Such a liquid consists primarily of water, normally greater than about 90 weight percent water, and can be essentially pure water in certain circumstances. For example, a solvent having an aqueous character can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith (e.g., various alcohols, polyols or humectants such as glycerin or polypropylene glycol).

Methods for extracting components from tobacco materials, separating extracts from unextracted tobacco materials, and isolating tobacco extracts will be apparent to the skilled artisan.

The tobacco extract can have various forms. For example, it is desirable to subject an aqueous extract to a spray drying, freeze drying, belt drying, flash drying, or other suitable solvent removal process in order to provide a tobacco extract in a substantially solventfree form. As such, tobacco extracts can have the form of a paste, a viscous liquid, a powder, a granular solid, a gel, or the like. Tobacco extracts can be processed as described in European Patent Application Nos. 326,370 and 338,831. Typically, tobacco extracts are provided in the form of spray dried extracts, freeze dried extracts, tobacco essences, or the like.

For purposes of this invention, spray drying is a one-step continuous process for removing a liquid from a solution and producing a dried particulate form of the extracted components within the solution by spraying a feed of the solution into a hot drying medium. Representative spray drying processes are described in U.S. Pat. No. 3,398,754 to Tughan and European Patent Application No. 326,370. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a solid form (e.g., as a powder) will be apparent to the skilled artisan.

The tobacco extract also can be subjected to treatment sufficient to remove significant quantities of high molecular weight tobacco components therefrom. Typical of such high molecular weight components are water soluble and/or dispersible polypeptides and proteins.

The preferred manner for removing the desired quantities of high molecular weight components from the aqueous solution involves the use of a membrane treatment such as ultrafiltration or reverse osmosis techniques. In particular, the aqueous solution of tobacco components which permeates a particular membrane is collected and employed in further process steps of the invention; and the high molecular weight components which are rejected by the membrane (i.e., which do not permeate the membrane) are collected and discarded.

The membrane which is employed to provide an aqueous solution of water soluble tobacco components having the high molecular weight water soluble components removed therefrom can vary. For example, membrane modules can include tubular modules, spiral wound modules and hollow fiber modules made from homogeneous polymeric materials such as cellulose acetate, polyamides and polysulfones. Especially preferred membranes are a spiral wound module available as a G-series Module from Desalination Systems, Inc. or a Millipore Pellicon system.

The molecular weight range which is rejected by (i.e., which does not permeate) a membrane which is employed according to the process of this invention can vary. For example, it may be desirable to employ a membrane which rejects a high percentage (e.g., greater than about 95 weight percent) of all components having a molecular weight in excess of a particular molecular weight cut off; while permitting permeation of a high percentage of components having a molecular weight below the molecular weight cut off. Typical nominal molecular weight cut off values for membranes useful according to the process of this invention sometimes are in excess of 3,000, occasionally are in excess of 5,000, often are in excess of 10,000, and frequently are in excess of 15,000. However, typical nominal molecular weight cut off values for membranes useful according to this invention do not exceed 30,000 in order that a significant amount of certain components having a molecular weight of less than 30,000 are removed from the aqueous solution. The selection of a membrane having a particular nominal molecular weight cut off will depend upon the particular application and will be apparent to the skilled artisan.

The dissolved solids content of the aqueous solution of tobacco components prior to membrane treatment can vary. Typically, the dissolved solids content of the aqueous solution ranges from greater than 0 to about 50 weight percent; oftentimes from about 3 to 40 weight percent; and preferably from about 15 to about 30 weight percent.

The extracted tobacco components can be provided at a predetermined solvent level (e.g., in a predetermined high moisture form) by evaporating the solvent from the mixture of solvent and extract. Vacuum distillation and thin film evaporation techniques are particularly preferred.

The tobacco extract is contacted with an ammonia compound capable of releasing ammonia or a base capable of releasing ammonia. The term "ammonia compound capable of releasing ammonia" is intended to include, in general, any compounds which incorporate some form of releasable ammonia, and includes free ammonia (e.g., ammonia gas typically as anhydrous) and compounds capable of releasing ammonia by itself or from tobacco material (e.g., ammonium hydroxide, ammonium carbonate, mono-,di-, or triamonium phosphate, amino acids, amino alcohols, amino sugars etc.). The term "base capable of releasing ammonia" is intended to include those bases which when in contact with the tobacco extract and when subjected to the heat treatment release ammonia and ammonia-containing compounds indigenous to the tobacco material in its natural or processed form. Such bases include carbonates, bicarbonates and hydroxides of alkali and alkali earth metals such as potassium, sodium, calcium and magnesium, for example.

The tobacco extract can be in contact with an aqueous liquid in order to provide a moist extract. Certain tobacco extracts which are extracted using an aqueous liquid may have a significant moisture content, and do not require further addition of aqueous liquid thereto. The manner of contacting a low moisture content tobacco extract with the aqueous liquid can vary and is not particularly critical. Typically, the extract and liquid are mixed using stirring or agitation, and often employing gentle heating.

The amount of water relative to the tobacco extract (i.e., the moisture content of the extract) can vary when the heat treatment step of the process of the present invention is performed. Typically, the moisture content of the extract is at least 5 weight percent, and frequently at least about 25 weight percent. Normally, the moisture content of the extract does not exceed about 90 weight percent, and frequently does not exceed about 80 percent.

The moist tobacco extract can be contacted with a substrate. Preferred substrates are normally solid materials and are thermally stable at those temperatures experienced during the heat treatment steps of the present invention. Examples of suitable substrate materials include porous carbons, carbon fibers, carbon yarns, high surface area glass beads, aluminas, clays, and the like. Typical substrates are aluminas available as D-2 Sintered Alpha Alumina from W. R. Grace & Co. and carbon yarns available as Kynol Catalogue No. CFY- 020Y-3 from American Kynol, Inc. Furthermore, the moist tobacco extract can be contacted with an organic liquid. Examples of organic liquids include polyhydric alcohols (e.g., glycerin and propylene glycol).

The tobacco extract can also be contacted with at least one amino acid, amino acid analog or amino acid source (e.g., glutamine, asparagine, proline, alanine, cystine, aspartic acid, phenylalanine, glutamic acid) and at least one sugar or sugar source (e.g., fructose, sucrose, glucose, maltose).

If desired, flavoring agents (e.g., cocoa, licorice, St. John's bread, spices, herbs, and the like) can also be added to the tobacco extract.

The tobacco composition is subjected to moderately high temperature treatment such as described in U.S. Ser. No. 451,175 filed Dec. 18, 1989, the disclosure of which is incorporated herein by reference. Typically, such treatment involves exposing the tobacco composition to a temperature above about 100° C., preferably above about 110° C., and more preferably above about 120° C. However, it is desirable to subject the tobacco composition to a temperature below about 250° C., more desirably below about 200° C., in order to avoid an undesirable formation of components which are deleterious to the taste characteristics of the tobacco composition.

The moderately high temperature treatment of the tobacco composition can be performed under an inert atmosphere. For example, nitrogen and argon gas can be employed in order to provide an inert atmosphere. However, the heat treatment can be conducted under ambient atmosphere (i.e., air).

The moderately high temperature treatment is performed in a pressure controlled environment. Such an environment is provided by enclosing the tobacco composition in an air sealed vessel or chamber. Typically, a pressure controlled environment is provided using a pressure vessel or chamber which is capable of withstanding relatively high pressures. Such vessels or chambers (i) provide enclosure or concealment of the tobacco composition such that volatile flavor components of the tobacco extract are not lost or do not otherwise escape during the moderately high temperature treatment step, and (ii) provide for treatment of the tobacco composition at a temperature significantly above about 100° C. Preferred pressure vessels are equipped with an external heating source. Examples of vessels which provide a pressure controlled environment include a Parr Reactor Model No. 4522 and a Parr Reactor Model No. 4552 available from The Parr Instrument Co. Operation of such exemplary vessels will be apparent to the skilled artisan. Typical pressures experienced by the tobacco composition during the process of the present invention in such vessels range from about 10 psig to about 1,000 psig, normally from about 20 psig to about 500 psig.

The amount of time that the tobacco composition is subjected to the moderately high temperature treatment can vary. Normally, the time period is sufficient to heat an entire tobacco composition at the desired temperature for a period of at least about 10 minutes, preferably at least about 20 minutes. Normally, the time period is less than about 3 hours, preferably less than about 1 hour. However, it is desirable to control the time/temperature profile of tobacco compositions subjected to heat treatment so that each tobacco composition is not subjected to a particularly high temperature for a lengthy period of time. It is highly desirable to employ a pressure vessel design or a vessel equipped with an agitation mechanism such that the tobacco composition experiences a relatively uniform temperature throughout the treatment period. In particular, it is highly desirable for the entire tobacco composition to be heated uniformly throughout as much as possible at the maximum temperature to which the tobacco composition is subjected.

Conditions provided during the process of the present invention most desirably are such that certain components of the tobacco extract undergo the Maillard Reactions. The Maillard reactions or "browning reactions" are reactions between (i) the amino substituents of amino acids, peptides, proteins or other nitrogen-containing compounds, and (ii) the carbonyl group of a sugar in the reducing form or other carboxyl-containing compounds which are indigenous or added to the tobacco composition. Such reactions result in a significant darkening of the tobacco extract, typically to an extremely dark brown color. Such reactions often result in a moist tobacco extract of increased viscosity, particularly when the extract is subjected to relatively high temperature treatment for a relatively long period of time. See, Maillard, Ana. Chim., Vol. 9, pp. 5 and 258 (1916); Hodge, J. Agric. Food Chem., Vol. 1, p. 928 (1953); Nursten, Food Chem., Vol. 6, p. 263 (1981) and Waller et al, ACS Symp. Ser. (1983).

After the tobacco composition has been subjected to the moderately high temperature treatment for the controlled period of time, the tobacco composition is collected. The tobacco composition is provided in various forms for use in the manufacture of smoking articles. For example, a heat-treated tobacco composition can be contacted with a liquid carrier such as glycerin, propylene glycol, ethanol, water, or the like, and employed as a form of tobacco in smoking article manufacture. Forms of heat-treated tobacco compositions can be applied directly to smokable materials. For example, tobacco cut filler, as well as the types of smokable materials described in U.S. patent application Ser. No. 276,161, filed Nov. 23, 1988, now U.S. Pat. No. 4,920,990 to Lawrence et al can be blended with about 0.01 to about 50 percent weight percent of the heat-treated tobacco extract, based on the weight of the smokable material. The tobacco composition can be dried, contacted with an adhesive agent, (e.g., water-soluble polysaccharide gums of either natural or synthetic origin), formed into a paste that can be extruded into a small continuous strand approximating the size of individual shreds of tobacco, and used as filler material in the manufacture of cigarettes. Alternatively, the paste can also be cast into sheets for subsequent shredding, if desired and used as part of a blend or as the sole blend component of a smokable article. Extrusion or sheet forming can be effected by various techniques known to those skilled in the art. Furthermore, the dried heattreated tobacco composition having the form of substrate and tobacco extract can be combined with other aerosol forming materials, and employed in the manufacture of those smoking articles described in U.S. Pat. No. 4,708,151 to Shelar; U.S. Pat. No. 4,771,795 to White et al; U.S. Pat. No. 4,714,982 to Banerjee et al; U.S. Pat. No. 4,756,318 to Clearman et al; and U.S. Pat. No. 4,793,365 to Sensabaugh et al; as well as European Patent Publication Nos. 212.234 and 277,519. In addition, the heat-treated tobacco compositions can be incorporated into those smoking articles described in U.S.

patent application Ser. No. 414,833 filed Sept. 29, 1989 and European Patent Publication No. 280,990.

The following examples are provided in order to further illustrate various embodiments of the invention but should not be construed as limiting the scope thereof. Unless otherwise noted, all parts and percentages are by weight.

EXAMPLE 1

Cigarette dust is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of flavorful tobacco volatile is minimized. The concentrated aqueous extract then is spray dried by continuously pumping the aqueous solution to an Anhydro Size No. 1 spray dryer. The dried powder is collected at the outlet of the dryer. The inlet temperature of the spray dryer is about 215° C., and the outlet temperature is about 82° C. The spray dried material is a brown, powdery material, and has a moisture content of about 5 percent to about 25 percent.

The spray dried extract is mixed with water. In particular, about 2291 g of the extract is mixed with about 5235 g of water. The resulting moist extract is then placed in a Parr Reactor Model No. 4522 equipped with a temperature control unit available as Parr No. 4842-PID from The Parr Instrument Co. Anhydrous ammonia gas is bubbled through the extract for about 30 seconds. The pressure vessel is equipped with a mechanical stirrer. The moist extract then is subjected to exposure to a maximum temperature of about 180° C. for about 30 minutes at a pressure of about 150 psig. Then, the tobacco composition is removed from the pressure vessel. The tobacco composition exhibits an extremely dark brown color and a pleasant aroma. The odor of ammonia is non-detectable.

The tobacco composition is removed and applied at about 5000 ppm to a cigarette having an "American" blend and is aged for two weeks at room temperature. The cigarette exhibits a strong full-bodied tobacco odor and a sweet aroma. The cigarette smoke exhibits an excellent, well-rounded tobacco taste with a smooth and mild smoker perception.

EXAMPLE 2

Spray dried tobacco extract is provided as described in Example 1. The spray dried extract is contacted with water and potassium carbonate. In particular, about 175 g of the extract is mixed with 400 g of water and 20 g of potassium carbonate in the pressure vessel described in Example 1. The mixture is subjected to exposure to a maximum temperature of about 180° C. for 30 minutes at a pressure of about 200 psig.

The tobacco composition is removed and applied at about 5000 ppm to a cigarette having an "American" blend of tobacco and is aged at room temperature for two weeks. The cigarette exhibits a strong full-bodied tobacco odor and a sweet aroma. The cigarette smoke exhibits an excellent, well-rounded tobacco taste with a smooth and mild smoker perception.

EXAMPLE 3

Spray dried tobacco extract is provided as described in Example 1. The spray dried extract is contacted with water and ammonium hydroxide (27% ammonia). In particular, about 2291 g of the extract is mixed with 5235 g of water and 121 g of ammonium hydroxide in the pressure vessel described in Example 1. The mixture is subjected to exposure to a maximum temperature of about 180° C. for 30 minutes at a pressure of about 170 psig.

The tobacco composition is removed and applied at about 5000 ppm to a cigarette having an "American" blend of tobacco and is aged at room temperature. The cigarette exhibits a strong full-bodied tobacco odor and a sweet aroma. The cigarette smoke exhibits an excellent, wellrounded tobacco taste with a smooth and mild smoker perception.

That which is claimed is:

1. A process for altering the chemical nature of a tobacco extract, the process comprising the steps of:

(a) extracting tobacco material with an extraction solvent to provide a tobacco extract;

(b) contacting the tobacco extract with an ammonia compound capable of releasing ammonia; and (c) subjecting the tobacco extract to heat treatment (i) in a pressure controlled environment to above ambient pressure, and (ii) at a temperature above about 100° C. so as to alter the chemical nature of the tobacco extract.

2. The process of claim 1 whereby the extraction solvent is a liquid having an aqueous character.

3. The process of claim 1 or 2 whereby the ammonia compound capable of releasing ammonia is anhydrous ammonia gas.

4. The process of claim 1 or 2 whereby the ammonia compound capable of releasing ammonia is ammonium hydroxide.

5. The process of claim 1 or 2 whereby the tobacco material is ammoniated.

6. The process of claim 1 or 2 including providing the tobacco extract in step (a) such that the moisture content thereof is at least about 5 percent.

7. The process of claim 1 or 2 whereby step (b) includes contacting the tobacco extract with an amino acid and/or sugar prior to step (c).

8. The process of claim 1 or 2 whereby the tobacco extract provided in step (a) is subjected to treatment sufficient to remove high molecular weight tobacco components from the tobacco extract.

9. The process of claim 1 or 2 whereby the extract is subjected to heat treatment at a temperature below about 250° C.

10. The process of claim 1 or 2 whereby the extract is subjected to heat treatment at a temperature above about 100° C. and at a pressure of about 10 psig to about 1,000 psig.

11. The process of claim 10 whereby the extract is subjected to heat treatment at a pressure of about 20 psig to about 500 psig.

12. A process for altering the chemical nature of a tobacco extract, the process comprising the steps of:

(a) extracting tobacco material with an extraction solvent to provide a tobacco extract;

(b) contacting the tobacco extract with a base of releasing ammonia; and (c) subjecting the tobacco extract to heat treatment (i) in a pressure controlled environment at above ambient pressure, and (ii) at a temperature above about 100° C. so as to alter the chemical nature of the tobacco extract.

13. The process of claim 12 whereby the extraction solvent is a liquid having an aqueous character.

14. The process of claim 12 or 13 whereby the tobacco material is ammoniated.

15. The process of claim 12 or 13 including providing the tobacco extract in step (a) such that the moisture content thereof is at least about 5 percent.

16. The process of claim 12 or 13 whereby the base capable of releasing ammonia is a carbonate of potassium, sodium, calcium or magnesium.

17. The process of claim 12 or 13 whereby the base capable of releasing ammonia is a bicarbonate of potassium, sodium, calcium or magnesium.

18. The process of claim 12 or 13 whereby step (b) includes contacting the tobacco extract with an amino acid and/or sugar prior to step (c).

19. The process of claim 12 or 13 whereby the tobacco extract provided in step (a) is subjected to treatment sufficient to remove high molecular weight tobacco components from the tobacco extract.

20. The process of claim 12 or 13 whereby the extract is subjected to heat treatment at a temperature below about 250° C.

21. The process of claim 12 or 13 whereby the extract is subjected to heat treatment at a temperature above about 100° C. and at a pressure of about 10 psig to about 1,000 psig.

22. The process of claim 21 whereby the extract is subjected to heat treatment at a pressure of about 20 psig to about 500 psig.

23. A process for altering the chemical nature of a tobacco extract, the process comprising the steps of:

(a) extracting tobacco material with an extraction solvent to provide a tobacco extract having a moisture content of at least about 5 percent;

(b) contacting the tobacco extract with an ammonia compound capable of releasing ammonia; and (c) subjecting the tobacco extract to heat treatment (i) in a pressure controlled environment at above ambient pressure, and (ii) at a temperature above about 100° C. so as to alter the chemical nature of the tobacco extract.

24. The process of claim 23 whereby the ammonia compound capable of releasing ammonia is anhydrous ammonia gas.

25. The process of claim 23 whereby the ammonia compound capable of releasing ammonia is ammonium hydroxide.

26. The process of claim 24 whereby the tobacco material is ammoniated.

27. The process of claim 23 whereby the step (b) includes contacting the tobacco extract with an amino acid and/or sugar prior to step (c).

28. The process of claim 23 whereby the tobacco extract provided in step (a) is subjected to treatment sufficient to remove high molecular weight tobacco components from the tobacco extract.

29. The process of claim 23 whereby the extract is subjected to heat treatment at a temperature below about 250° C.

30. The process of claim 23 whereby the extract is subjected to heat treatment at a temperature above about 100° C. and at a pressure of about 10 psig to about 1,000 psig.

* * * * *